US008845958B2

(12) United States Patent
Aoki et al.

(10) Patent No.: US 8,845,958 B2
(45) Date of Patent: Sep. 30, 2014

(54) PROCESS FOR MANUFACTURING NI-BASE ALLOY AND NI-BASE ALLOY

(75) Inventors: Chuya Aoki, Yasugi (JP); Toshihiro Uehara, Yasugi (JP); Takehiro Ohno, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 473 days.

(21) Appl. No.: 13/063,414

(22) PCT Filed: Sep. 25, 2009

(86) PCT No.: PCT/JP2009/066703

§ 371 (c)(1), (2), (4) Date: Mar. 10, 2011

(87) PCT Pub. No.: WO2010/038680

PCT Pub. Date: Apr. 8, 2010

(65) Prior Publication Data

US 2011/0171058 A1 Jul. 14, 2011

(30) Foreign Application Priority Data

Sep. 30, 2008 (JP) ..... 2008-253305
Mar. 4, 2009 (JP) ..... 2009-050835

(51) Int. Cl.
*C22C 19/05* (2006.01)
*C21D 11/00* (2006.01)
*C22F 1/10* (2006.01)

(52) U.S. Cl.
USPC ..... 420/449; 148/501; 148/428

(58) Field of Classification Search
USPC ..... 148/675, 677, 428, 501; 420/448, 449
See application file for complete search history.

(56) References Cited

U.S. PATENT DOCUMENTS 2,681,500 A * 6/1954 Whitehead ..... 29/889.7
4,789,410 A * 12/1988 Parizek ..... 148/527
5,131,961 A * 7/1992 Sato et al. ..... 148/677
5,556,594 A * 9/1996 Frank et al. ..... 420/448
2002/0015656 A1 2/2002 Magoshi et al.
2003/0155147 A1 8/2003 Robinson
2005/0236079 A1* 10/2005 Ueta et al. ..... 148/675
2007/0221298 A1 9/2007 Kurata et al.
2007/0284018 A1* 12/2007 Hamano et al. ..... 420/448

FOREIGN PATENT DOCUMENTS

CN 1367268 A 9/2002
JP 51-084726 A 7/1976
JP 2000-256770 A 9/2000
JP 3559681 B2 9/2004
JP 2006-176864 A 7/2006
JP 2007-204840 A 8/2007
JP 2007-332412 A 12/2007
JP 4037929 B2 1/2008
JP 2008-297579 A 12/2008
JP 2009-191301 A 8/2009
WO 2009/028671 A1 3/2009

OTHER PUBLICATIONS

"Camp-ISIJ" 2007, p. 1239, vol. 20, No. 6.
Chinese Office Action issued in Application No. 200980138674.5 dated Jan. 11, 2013, including an English language translation.
Extended European Search Report dated Jul. 31, 2013 for Application No. 09817713.2, 9 pages.
Chinese Office Action issued in Application No. 200980138674.5 dated Aug. 2, 2012.

* cited by examiner

*Primary Examiner* — Jessee Roe
(74) *Attorney, Agent, or Firm* — Sughrue Mion, PLLC

(57) ABSTRACT

Provided is an Ni-base alloy excellent in strength, ductility and other properties through the resolution of micro-segregation. Also provided is a process for manufacturing an Ni-base alloy containing by mass C:0.15% or less, Si:1% or less, Mn:1% or less, Cr:10 to 24%, Mo+(1/2)W (where Mo may be contained either alone or as an essential component):5 to 17%, Al:0.5 to 1.8%, Ti:1 to 2.5%, Mg:0.02% or less, and either B:0.02% or less and/or Zr:0.2% or less at an Al/(Al+0.56Ti) ratio of 0.45 to 0.70 with the balance consisting of Ni and impurities, which comprises subjecting, at least one time, an Ni-base alloy material which is prepared by vacuum melting and has the above composition to homogenization heat treatment at 1160 to 1220° C. for 1 to 100 hours. The Mo segregation ratio of the alloy is controlled to 1 to 1.17 by the homogenization heat treatment.

7 Claims, 2 Drawing Sheets

PROCESS FOR MANUFACTURING NI-BASE ALLOY AND NI-BASE ALLOY

CROSS REFERENCE TO RELATED APPLICATIONS

This application is a National Stage of Application No. PCT/JP2009/066703 filed Sep. 25, 2009, claiming priority based on Japanese Patent Application Nos. 2008-253305 filed Sep. 30, 2008 and 2009-050835 filed Mar. 4, 2009, the contents of all of which are incorporated herein by reference in their entirety.

TECHNICAL FIELD

The present invention relates to a process for manufacturing a Ni-base alloy suitably used for a member exposed to a high temperature of a thermal power plant especially under an ultra super critical (USC) pressure steam condition, and to the Ni-base alloy.

BACKGROUND ART

Since blades and disks of a steam turbine used in a thermal power plant are exposed to a high temperature, these must have high properties such as creep rupture strength, creep rupture ductility, and oxidation resistance. In recent years, global environment protection, reduction of $CO_2$ emission, and so on have been demanded, which also have posed a need for the thermal power plant to have higher efficiency.

The steam temperature of the steam turbine reaches 600 to 630° C., so that a ferritic heat-resistant 12Cr-steel has been used at present. To meet the need for still higher efficiency in the future, it has been studied to make the steam temperature as high as not lower than 700° C. However, the currently used ferritic heat-resistant 12Cr-steel lacks sufficient high-temperature strength at 700° C. Thus, it has been studied to use a austenitic γ'-precipitation-strengthening Ni-base superalloy excellent in high-temperature strength.

However, the Ni-base super alloy has some disadvantages of a high thermal expansion coefficient, low creep rupture ductility, tendencies of segregation, and a high price while having enough creep rupture strength.

Therefore, various studies have been made to solve these problems in order to make it possible to practically use the Ni-base superalloy in a 700° C.-class ultra super critical pressure thermal power plant.

In Patent publications 1 and 2, the present applicant has proposed a Ni-base alloy aiming at attaining satisfactory properties of a low thermal expansion coefficient, creep rupture strength, creep rupture ductility, and oxidation resistance in order to use it at a temperature of 650° C. In Non-patent publication 1, there is reported that various precipitation-strengthening Ni-base alloys were inspected about tendencies of macro segregation thereof, and that the Ni-base alloy proposed in Patent publications 1 and 2 is advantageous in producing relatively big size ingots because of those low critical values of occurrence of segregation.

Thus, the alloy proposed in Patent publication 1 or 2 has been noticed that it exhibits both of high temperature strength and hot workability when used for medium or small size forgings such as steam turbine blades and bolts and for big size products such as steam turbine rotors and boiler tubes.

PRIOR ART PUBLICATION

Patent Publication

Patent publication 1: JP-4037929-B2
Patent publication 2: JP-3559681-B2

Non-Patent Publication

Non-patent publication 1: "CAMP-ISIJ" Vol. 20, No. 6, page 1239

DISCLOSURE OF THE INVENTION

Problems to be Solved by the Invention

The medium or large size products such as steam turbines, boilers, and so on used in the aforementioned 700° C.-class ultra super critical pressure thermal power plant are required to have higher reliability because of those very severe operational environments.

The Ni-base alloy has an advantage that a much amount of alloying elements can be dissolved therein because it has an austenitic matrix structure. While it can have excellent properties of high-temperature strength by making use of the advantage, a much amount of additive alloying elements is liable to cause segregation in the Ni-base alloy thereby deteriorating the Ni-base alloy in productivity and forging property.

Therefore, the present inventors conducted detailed studies to make the Ni-base alloy proposed in Patent publication 1 or 2 to be more surely applicable to the medium or large size products such as steam turbines, boilers, and so on, which are used in the 700° C.-class ultra super critical pressure thermal power plant. As a result, the present inventors confirmed that by making amounts of additive elements of Mo, Al and Ti, which are liable to be enriched in front of solidification in a melting process, to be well balanced, certainly macro segregation is restrained, and productivity and forging property of large size ingots are improved as taught in Non-patent publication 1.

On the other hand, a micro segregation will occur, for example, by enrichment of alloying elements among dendrites during solidifying. There is a risk that a notable micro segregation may deteriorate the Ni-base alloy in mechanical properties such as strength and ductility. The present inventors confirmed the presence of micro segregation even in the Ni-base alloy proposed in Patent publication 1 or 2. As set forth above, the Ni-base alloy used in the 700° C.-class ultra super critical pressure thermal power plant is required to have higher reliability, so that it is important for the Ni-base alloy to have stable and satisfactory mechanical properties.

Accordingly, in order to eliminate the micro segregation, the present inventors studied about a further control of chemical compositions of the Ni-base alloy. However, it was impossible to satisfactorily eliminate the micro segregation only by the control of chemical compositions.

The presence of micro segregation deteriorates the Ni-base alloy in mechanical properties such as strength and ductility, and may pose a critical problem in practical application of the Ni-base alloy to the medium or big size products such as steam turbines and boilers.

Herein, the term "macro segregation" means a segregation caused in an ingot by a density difference in molten metal due to a concentration difference between a mother liquid phase and an enriched liquid phase in a solid/liquid coexisting temperature zone generated after the start of solidification of the molten metal, and the term "micro segregation" means a segregation caused due to a concentration difference between a dendritic crystal generated during solidification of the molten metal and finally solidified parts between the dendritic crystals.

An object of the present invention is to solve the micro segregation problem thereby providing a Ni-base alloy having stable and satisfactory mechanical properties such as strength and ductility.

Means for Solving the Problem

On the basis of the alloys taught in Patent publications 1 and 2, the present inventors made a keen study about a method of surely reducing the micro segregation, thereby it was confirmed that alloying elements and contents thereof disclosed in the Patent publications are substantially proper in light of decreasing the micro segregation. Furthermore, studying manufacturing processes of the alloys, the present inventors found that the micro segregation can be restrained by subjecting the alloys to a homogenization heat treatment in an extremely limited temperature range after vacuum melting, thereby having led to the present invention.

According to the present invention, there is provided a process for manufacturing a Ni-base alloy comprising, by mass, not more than 0.15% carbon, not more than 1% Si, not more than 1% Mn, 10 to 24% Cr, a combination of an essential element of Mo and an optional element W in terms of $5\% \leq Mo+(W/2) \leq 17\%$, 0.5 to 1.8% Al, 1 to 2.5% Ti, not more than 0.02% Mg, at least one element selected from the group consisting of not more than 0.02% B and not more than 0.2% Zr, and the balance of Ni and unavoidable impurities, wherein the value of Al/(Al+0.56Ti) is 0.45 to 0.70, and wherein the Ni-base alloy material, having the above chemical composition, obtained by vacuum melting, is subjected to a homogenization heat treatment at a temperature of 1,160 to 1,220° C. for 1 to 100 hours at least one time.

According to one embodiment of the invention, a Mo segregation ratio of 1 to 1.17 of the Ni-base alloy material is attained by the homogenization heat treatment.

Preferably, the Mo segregation ratio is 1 to 1.10.

According to one embodiment of the invention, the Ni-base alloy may further comprise not more than 5% Fe.

Preferably the Ni-base alloy comprises, by mass, 0.015 to 0.040% carbon, less than 0.1% Si, less than 0.1% Mn, 19 to 22% Cr, 9 to 12% of "Mo+(½)×W", where Mo is an essential element, 1.0 to 1.7% Al, 1.4 to 1.8% Ti, 0.0005 to 0.0030% Mg, 0.0005 to 0.010% B, 0.005 to 0.07% Zr, and not more than 2% Fe, wherein a value of Al/(Al+0.56Ti) is 0.50 to 0.70. In this chemical composition range, the Ni-base alloy is most suitably used in an environment at a temperature of not lower than 700° C.

With regard to the Al amount, the Ni-base alloy can have excellent creep property in the case of 1.0 to 1.3% Al, and excellent tensile strength in the case of from more than 1.3% to 1.7% Al.

Preferably, the Ni-base alloy material is subjected to vacuum arc remelting or electroslag remelting between the vacuum melting and the homogenization heat treatment.

According one embodiment of the invention, the Ni-base alloy is subjected to hot forging after the homogenization heat treatment resulting in the Mo segregation ratio of 1 to 1.17, preferably 1 to 1.10.

The present invention is directed to also the Ni-base alloy which comprises, by mass, not more than 0.15% carbon, not more than 1% Si, not more than 1% Mn, 10 to 24% Cr, 5 to 17% of "Mo+(½)×W", where Mo is an essential element, 0.5 to 1.8% Al, 1 to 2.5% Ti, not more than 0.02% Mg, at least one element selected from the group consisting of not more than 0.02% B and not more than 0.2% Zr, and the balance of Ni and unavoidable impurities, wherein the value of Al/(Al+0.56Ti) is 0.45 to 0.70, and wherein the Mo segregation ratio is 1 to 1.17.

Preferably, the Mo segregation ratio is 1 to 1.10.

The Ni-base alloy may further comprise not more than 10% Fe.

The Ni-base alloy may be a forged product.

The Ni-base alloy may further comprise not more than 5% Fe.

A preferred embodiment of the invention Ni-base alloy comprises, by mass, 0.015 to 0.040% carbon, less than 0.1% Si, less than 0.1% Mn, 19 to 22% Cr, 9 to 12% of "Mo+(½)×W", where Mo is an essential element, 1.0 to 1.7% Al, 1.4 to 1.8% Ti, 0.0005 to 0.0030% Mg, 0.0005 to 0.010% B, 0.005 to 0.07% Zr and not more than 2% Fe, wherein the value of Al/(Al+0.56Ti) is 0.50 to 0.70.

With regard to the Al amount, the Ni-base alloy can have excellent creep property in the case of 1.0 to 1.3% Al, and excellent tensile strength in the case of from more than 1.3% to 1.7% Al.

A preferred embodiment of the Ni-base alloy has a metal structure not having a region in which a series of ten or more Mo rich carbides, each having a size of not less than 3 μm, are continuously present at intervals of not more than 10 μm.

The Ni-base alloy may be a forged material.

Advantages of the Invention

The invention Ni-base alloy improved in the micro segregation, so that advantageously it has more stably improved mechanical properties of strength and ductility in a service environment at a temperature of not lower than 700° C. Thus, medium and large-sized forged products such as steam turbines and boilers with use of the Ni-base alloy have a higher reliability.

BEST MODE FOR CARRYING OUT THE INVENTION

Figure 1:
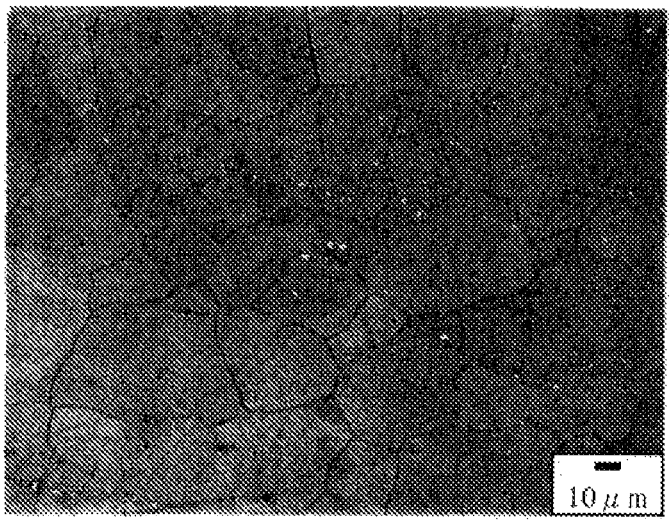
FIG. 1 is an optical micro-photographic cross-sectional view of a Ni-base alloy of the present invention subjected to homogenization heat treatment at 1,180° C.

First, the elements and the contents thereof defined in the present invention will be explained. Unless otherwise noted, the contents are indicated by mass percent.

C (carbon) forms carbides in combination with alloying elements. The carbides formed after melting are dissolved in a γ phase of matrix by solid-solution heat treatment, and thereafter the carbides precipitate at crystal grain boundaries and in crystal grains to contribute to precipitation strengthening of the Ni-base alloy even if the carbon content is small, since carbon is hardly dissolved in the γ phase of matrix.

Particularly, the carbides precipitated at grain boundaries restrain a grain boundary dislocation at a high temperature thereby improving the strength and ductility of the Ni-base alloy.

However, if the carbon content is excessive, the carbides are liable to precipitate like a stringer, so that the Ni-base alloy is deteriorated in the ductility along the right angle direction to a working direction of the Ni-base alloy. Further, if carbon combines with Ti to form carbides, a Ti amount for forming a γ' phase can not be ensured, which γ' phase is an important precipitation strengthening phase formed by a combination of Ti and Ni. Thus, the carbon content is limited to not more than 0.15%. The carbon content is preferably 0.01 to 0.080%, and preferably 0.015 to 0.040% in the case of an operational environment at not lower than 700° C.

Si is used as a deoxidizer during melting the alloy. Further, Si is effective for restraining exfoliation of an oxide layer. However, if the Si content is excessive, the alloy is deteriorated in ductility and workability, so that the Si content is limited to not more than 1%. Preferably the Si content is up to 0.5%, more further preferably not more than 0.2%. In the case of an operational environment at not lower than 700° C., preferably the Si content is less than 0.1%.

Mn is used as a deoxidizer and a desulfurizer during meting the alloy. If the alloy contains oxygen and sulfur as unavoidable impurities, those segregate at grain boundaries and lower the melting point of the alloy thereby causing hot brittleness which occurs local melting of the grain boundaries during hot working of the alloy, so that Mn is used for deoxidization and desulfurization. Further, Mn is effective for restraining oxidation of grain boundaries by forming a dense and firm oxide layer. However, the Mn content is excessive, the alloy is deteriorated in ductility, so that the Mn content is limited to not more than 1%, preferably not more than 0.5%, more preferably not more than 0.2%, and furthermore preferably less than 0.1% in the case of an operational environment at not lower than 700° C.

Cr combines with carbon to strengthen crystal grain boundaries thereby improving the alloy in strength and ductility at a high temperature and significantly relaxing a sensibility to notch rupture. Further, Cr is dissolved in a matrix of the alloy to improve the alloy in oxidation and corrosion resistance properties. However, if the Cr content is less than 10%, the above effects are not obtainable. If the Cr content is excessive, there will arise a problem of an occurrence of cracking at a high temperature due to an increased thermal expansion coefficient, and another problem of low productivity and workability of the alloy. Thus, the Cr content is limited to 10 to 24%, preferably 15 to 22%, and in the case of an operational environment at not lower than 700° C., preferably 19 to 22%, more preferably 18.5 to 21.5%. Mo and W are dissolved in a matrix of the alloy to strengthen the matrix and lower the thermal expansion coefficient of the alloy. Since the Ni-base alloy has a high thermal expansion coefficient, it has a problem of susceptibility to thermal fatigue at a high temperature thereby lacking in reliability for a stable use. Mo is an element most effective in lowering the thermal expansion coefficient of the alloy, so that an indispensable element of Mo alone, or two elements of Mo and W are added to the alloy. If the amount of Mo+(½)×W is less than 5%, the above effect is not obtainable, and if the amount thereof exceeds 17%, the alloy is confronted with difficulties in productivity and workability. Thus, the amount of Mo+(½)×W is limited to 5 to 17%, where Mo is indispensable. In order to restrain occurrence of macro segregation to the utmost, the amount of Mo+(½)×W is preferably 7 to 13%, and in the case of an operational environment at not lower than 700° C., preferably 9 to 12%, more preferably 9 to 11%.

Al is added to improve high temperature strength of the alloy, since it forms an intermetallic compound ($Ni_3(Al, Ti)$) called a γ' phase together with Ni and Ti. If the Al content is less than 0.5%, the above effect is not obtainable, while an excessive amount of Al deteriorates the alloy in productivity and workability. Thus, the Al content is limited to 0.5 to 1.8%. In order to restrain occurrence of macro segregation to the utmost, the Al content is preferably 1.0 to 1.8%, and in the case of an operational environment at not lower than 700° C., the Al content is preferably 1.0 to 1.7%.

Making much of the creep properties of the alloy at a temperature of not lower than 700° C., and in the case of making much of high-temperature strength at a temperature of 700° C., the Al content is preferably from more than 1.3% to 1.7%.

Ti forms the γ' phase ($Ni_3(Ti, Al)$) like Ni and Al to improve the alloy in high temperature strength. The Ti intermetallic compound much more contributes to alloy strengthening as compared to $Ni_3Al$ since Ti causes the matrix of the alloy to elastically strain because of a larger atomic diameter of Ti than that of Ni. If the Ti content is less than 1%, the above effects cannot be obtained, and an excessive amount of Ti deteriorates the alloy in productivity and workability, so that the Ti content is limited to 1 to 2.5%. In order to restrain occurrence of macro segregation to the utmost, the Ti content is preferably 1.2 to 2.5%, and in the case of an operational environment at a temperature of not lower than 700° C., the Ti content is preferably 1.4 to 1.8%.

$Ni_3Ti$ is much more effective in improvement of high temperature strength of the alloy as compared with $Ni_3Al$. However, $Ni_3Ti$ is inferior in the phase stability at a high temperature as compared with $Ni_3Al$, so that it is liable to become a brittle η phase at a high temperature. Thus, by co-additives of Ti and Al, the γ' phase is caused to precipitate in the form of ($Ni_3(Al, Ti)$) in which Al and Ti are partially replaced with each other. The alloy is provided with higher strength at a high temperature by $Ni_3(Al, Ti)$, as compared with reliance on $Ni_3Al$, while deteriorating ductility. On the other hand, the much more the Al content, the more largely the alloy is improved in ductility while deteriorating strength. Therefore the content balance of Al and Ti is important. It is important to ensure the invention alloy to have enough ductility, so that a value of Al/(Al+0.56Ti) has been used in the invention in order to express a rate of Al in the γ' phase as an atomic weight ratio. If the value is smaller than 0.45, it is impossible to obtain enough ductility of the alloy. Contrasting, if the value exceeds 0.70, the alloy strength is insufficient. Thus, the value of Al/(Al+0.56Ti) is limited to 0.45 to 0.70, more preferably 0.50 to 0.70 in the case of an operational environment at a temperature of not lower than 700° C.

Mg is used as a desulfurizer during alloy melting. It combines with sulfur to form a compound thereby restraining occurrence of sulfur segregation at grain boundaries to improve the alloy in hot workability. However, an excessive amount of additive Mg deteriorates the alloy in ductility and workability. Thus, the Mg content is limited to not more than 0.02%. The Mg content is preferably up to 0.01%, more preferably 0.0005 to 0.0030% in the case of an operational environment at a temperature of not lower than 700° C.

B (boron) and Zr are used to strengthen crystal grain boundaries of the alloy, and it is needed to add one or two of them. They have a considerably smaller atomic size than Ni, which is an atom forming the alloy matrix, so that they segregate at crystal grain boundaries to restrain a dislocation at grain boundaries at a high temperature. Particularly, they significantly reduce susceptibility to notch rupture thereby enabling the alloy to have improved properties of creep rupture strength and creep rupture ductility. However, excessive amounts of additive B and Zr deteriorate the alloy in oxidation resistance property. Thus, the B and Zr contents are limited to not more than 0.02% and not more than 0.2%, respectively. The B and Zr contents are preferably up to 0.01% and up to 0.1%, respectively. In the case of an operational environment at a temperature of not lower than 700° C., the B and Zr contents are more preferably 0.0005 to 0.010% and 0.005 to 0.07%, respectively.

While Fe is not always to be added, it improves the alloy in hot workability, so that it may be added to the alloy as occasion demands. If the Fe content exceeds 5%, there arise problems that a thermal expansion coefficient of the alloy increases thereby generating cracks when the alloy is used at a high temperature, and that the alloy deteriorates in oxidation resistance property. Thus, the Fe content is limited to not more than 5%. In the case of an operational environment at a temperature of not lower than 700° C., the Fe content is more preferably not more than 2.0%.

The balance of Ni is an austenite forming element. Since the austenitic phase consists of densely filled atoms, the atoms diffuse slowly even at a high temperature, so that the austenitic phase has a higher high-temperature strength than the ferritic phase. Further, an austenitic matrix has a high solubility limit of alloying elements, so that it is advantageous to precipitation of the γ' phase, which is indispensable for precipitation strengthening of the alloy, and to solid-solution-strengthening the austenitic matrix itself. Since Ni is the most effective element for forming the austenitic matrix, the balance of the alloy is Ni in the present invention. Of course the balance contains impurities.

In the present invention, by controlling the above chemical compositions, the macro segregation can be reduced.

In the present invention, the macro segregation is prevented by controlling the above chemical compositions, and the micro segregation can be prevented more reliably with use of a proper production process.

Herein below, there will be provided a description about reasons why the production process is restricted to the defined invention method.

In the present invention, an ingot, an electrode for vacuum arc remelting (hereinafter, referred to as VAR), and an electrode for electroslag remelting (hereinafter, referred to as ESR), whose chemical compositions are adjusted to those explained above by vacuum melting, are produced.

The vacuum melting is carried out because of the following reasons.

The Ni-base alloy defined in the present invention contains indispensable additive elements of Al and Ti, which are elements forming the γ' phase, in order to obtain high strength at a high temperature. Since Al and Ti are active elements, detrimental oxides and nitrides are liable to be formed when the alloy is melted in air. Thus, it is needed to carry out vacuum melting having a degassing effect in order to prevent precipitation of detrimental nonmetallic inclusions such as oxides and nitrides.

Also, if Al and Ti form much oxides and nitrides, the Al and Ti amounts in a solid solution decrease, so that the γ' phase, which is precipitated by aging treatment and contributes to strengthening of the Ni-base alloy, decreases thereby deteriorating the Ni-base alloy in strength. Therefore, it is needed to carry out vacuum melting of the Ni-base alloy, which is capable of restraining formation of oxides and nitrides as far as possible.

Further, according to the vacuum melting having a refining effect, it is possible to remove detrimental elements.

As stated above, the vacuum melting is an indispensable means for preventing nonmetallic inclusions from precipitating and removing impurity elements thereby improving the Ni-base alloy in quality.

For a heat-resisting alloy like as the invention alloy having high reliability, it is possible to further reduce the macro segregation and obtain the refining effect by carrying out the remelting process of VAR or ESR with use of an electrode as a raw material (i.e. an ingot) made of the Ni-base alloy having the above chemical composition and obtained by vacuum melting.

The Ni-base alloy raw material after vacuum melting is subjected to homogenization heat treatment at a temperature of 1,160 to 1,220° C. for 1 to 100 hours in order to eliminate the micro segregation.

The followings are reasons why the homogenization heat treatment temperature is determined to be in the above range.

The reason of setting the lower limit of homogenization heat treatment temperature being 1,160° C. is that if the temperature is lower than 1,160° C., the micro segregation can not be eliminated. In the case of lower than 1,160° C., there will remain micro variations (i.e. segregation) in concentration of alloying elements thereby resulting in locally deteriorated mechanical properties in the same ingot or electrode.

On the other hand, if the upper limit of the homogenization heat treatment temperature exceeds 1,220° C., since the temperature is immediately under the melting point of the invention alloy having the defined chemical compositions, there will occur local melting in a concentrated region of the solute components caused by micro segregation thereby arising a defect in the melted region due to solidification shrinkage during cooling. Further, if the local melting occurs, not only micro segregation is not eliminated, but also micro segregation rather increases, so that the effect of the homogenization heat treatment is lost thereby resulting in that the mechanical properties of the alloy may be deteriorated, or variations thereof may occur. Therefore, in the present invention, the homogenization heat treatment temperature should be within an extremely limited range of 1,160 to 1,220° C.

The lower limit of the homogenization heat treatment temperature is preferably 1,170° C., and the upper limit thereof is preferably 1,210° C.

The following is a reason why the homogenization heat treatment is carried out within the above time range.

Since the effect of reducing the micro segregation by means of the homogenization heat treatment depends more greatly on the treatment temperature than on the treatment time, although the homogenization heat treatment may be conducted in a short time at a high temperature, the homogenization heat treatment must be conducted in a longer time at a low temperature. Thus, the homogenization heat treatment time range was determined as stated above. If the homogenization heat treatment time is shorter than 1 hour, the effect of eliminating the micro segregation is not obtainable even at a proper homogenization heat treatment temperature. Therefore, the lower limit of the homogenization heat treatment time was set to be 1 hour. The lower limit of the homogenization heat treatment time is preferably 5 hours, more preferably 8 hours, and still further preferably 18 hours.

On the other hand, even if the homogenization heat treatment is carried out for a time exceeding 100 hours in the above temperature range, a much more effect of reducing the micro segregation is not obtainable. Thus, the upper limit of the homogenization heat treatment time was determined to be 100 hours, more preferably 40 hours, further preferably 30 hours.

The above homogenization heat treatment may be applied to an ingot after vacuum melting, or an electrode for VAR or ESR produced by vacuum melting, or an ingot after remelting for which a description will be provided later.

For example, in the case where the homogenization heat treatment is carried out two or more times, it is effective to do so one time after vacuum melting, and one or more times after hot pressing, hot forging or remelting.

In the case of the present invention, it is possible to reduce occurrence of the macro segregation in an ingot, an electrode for VAR, or an electrode for ESR, since a composition balance between the Al and Ti amount and the Mo amount is controlled, where Al and Ti are susceptible to a floating type segregation, and Mo is susceptible to a settling type segregation.

However, for example, if the macro segregation remains, there is a possibility of occurrence of cracking in the alloy during hot pressing and hot forging. Further, for example, when VAR is carried out, there is a possibility that it is impossible to carry out an enough melting of the alloy because of occurrence of unstable arc to an electrode due to the macro segregation.

Therefore, the ingot, the electrode for VAR and the electrode for ESR after vacuum melting may be subjected to the homogenization heat treatment under the conditions of the temperature and the treatment time set forth above, thereby enabling to obtain the effect of reducing both of the macro segregation and the micro segregation.

In the case where the alloy is subjected to remelting such as VAR and ESR after vacuum melting, the homogenization heat treatment is more effective in order to eliminate the micro segregation thereby when the remelting is conducted prior to the homogenization heat treatment.

Further, for example, in the case where the alloy is subjected to remelting such as VAR and ESR, with regard to the conditions of the homogenization heat treatment performed after vacuum melting, although it may be satisfactory to carry out the heat treatment within the specified temperature range, of which lower limit is 1,100° C., merely in order to further reduce the macro segregation, or cause intermetallic compounds to dissolve in a matrix, a temperature of lower than 1,160° C. as a condition of the homogenization heat treatment is improper in order to eliminate the micro segregation.

In the present invention, it is preferred to conduct VAR or ESR one or two times between the vacuum melting and the homogenization heat treatment. That is, for example, if processes of vacuum melting⇒ VAR or ESR⇒ homogenization heat treatment, or vacuum melting⇒ VAR or ESR⇒ VAR or ESR⇒ homogenization heat treatment are conducted, macro segregation can be reduced further, and at the same time, the effect of preventing micro segregation obtainable by the subsequent homogenization heat treatment can be ensured. Further, remelting may be conducted by VAR or ESR with use of an electrode produced by hot forging an ingot produced by vacuum melting.

The reason for this is as follows.

Both of VAR and ESR are effective in improving cleanliness of the alloy to upgrade the product quality by decreasing nonmetallic inclusions which deteriorates the alloy in mechanical properties, and in reducing segregation. Therefore, by conducting VAR or ESR once to sufficiently reduce macro segregation of the Ni-base alloy, the effect of eliminating micro segregation in the subsequent homogenization heat treatment can be ensured.

VAR or ESR effective in reducing segregation may be conducted twice. In such a case, the effect of eliminating micro segregation in the subsequent homogenization heat treatment can be ensured.

For example, even if an ingot produced by vacuum melting has not a needed weight, it is possible to obtain a large-sized uniform ingot in which macro segregation has been sufficiently eliminated by such a process that a plurality of ingots are produced under vacuum to be jointed to each other by welding to make a large electrode, and thereafter the jointed large electrode is subjected to a first-time ESR to reduce macro segregation near welded portions, and the thus obtained product is subjected to a second-time ESR in order to sufficiently eliminate macro segregation thereby obtaining the above large-sized ingot.

According to VAR, especially because of the vacuum atmosphere, a loss of active elements Al and Ti caused by oxidation or nitriding is restrained, and particularly excellent effects of degassing and deoxidization by virtue of oxide-floating separation can be obtained. In the case where ESR is applied, because of no degassing effect, although active elements of Al and Ti are promotionally reduced resulting in deterioration of mechanical properties, particularly sulfides and large size non-metallic inclusions are effectively removed. Further, since a vacuum pumping device is not always needed for the ESR, advantageously a comparatively simple equipment is sufficient therefor. Thus, VAR or ESR should be applied depending on the required properties of product and the manufacturing cost. Of course VAR and ESR may be used in combination.

Next, there will be provided a description of the segregation ratio defined in the present invention. In the invention, attention was paid to Mo which is an element susceptible to segregation. That is, in the invention, attention was paid to Mo as an index indicating that segregation was restrained sufficiently, and the Mo segregation ratio was specified in an extremely limited range of 1 to 1.17.

The segregation ratio as recited in the invention means a ratio of the maximum value to the minimum value of characteristic X-ray intensity obtained by an X-ray microanalyzer (hereinafter, referred to as EPMA) line analysis. Thus, when Mo segregation is not found at all, the Mo segregation ratio is 1. If the micro segregation of Mo remains, the Mo segregation ratio is higher.

The upper limit of Mo segregation ratio is specified from the experience based on experiments. The reason why the upper limit is made to be 1.17 is that if it is not more than 1.17, it can be judged that micro segregation has been almost eliminated.

Although being described in detail in the later-described examples, if the Mo segregation ratio is not more than 1.17, a final product can be stably improved in mechanical properties. On the other hand, if the Mo segregation ratio exceeds 1.17, there occurs a decrease in properties caused by micro segregation, so that a final product is deteriorated in strength and ductility due to micro segregation.

Thus, in the invention, the upper limit of Mo segregation ratio determined to be 1.17, and more preferably the Mo segregation ratio is not more than 1.10.

In order to measure the micro segregation ratio of Mo, it is enough that Mo can be line analyzed with EMPA in the direction crossing a dendrite although in any direction in the case of ingot, and also in the direction at right angles to a longitudinal direction in the case of a forging. The reason for this is that since the above direction is parallel to a Mo concentration variation caused by segregation, the segregation can be detected by line analysis of a shorter distance. The measurement can be made more exactly as the analysis distance increases. However, it is unreal to measure an excessively long distance. According to the study conducted by the present inventors, a line analysis of only 3 mm length is satisfactory since the analysis can be well made by such a length.

In the present invention, hot forging may be conducted after homogenization heat treatment. A hot forging temperature may be about 1,000 to 1,150° C.

In the invention, as set forth above, the Mo segregation ratio is controlled to be in a range of 1 to 1.17 by homogenization heat treatment, so that there is no risk that the Mo segregation ratio increases as a result of hot forging. Thus, excellent mechanical properties are obtainable without deterioration of properties of the Ni-base alloy after hot forging.

In the invention, since macro segregation and micro segregation are restrained, it is possible to attain a metal structure not having a region in which a series of ten or more Mo rich carbides, each having a size of not less than 3 μm, are continuously present at intervals of not more than 10 μm. If there can not be found a zone in which the Mo rich carbides are locally present, or a presence of such a zone is very small, it is possible to obtain isotropically excellent mechanical properties.

Since Mo segregates in a region in which Mo rich carbides are present, it is possible to simply confirm traces of Mo segregation by observing a distribution state of Mo rich carbides. Also, since a local distribution of Mo rich carbides may affect recrystallization behavior thereby causing occurrence of a metal structure of mixed grains, it is possible to obtain a uniform crystal grain structure by restraining the local distribution of Mo rich carbides, thereby restraining occurrence of non-uniformity of mechanical properties such as strength and hardness.

Figure 2:
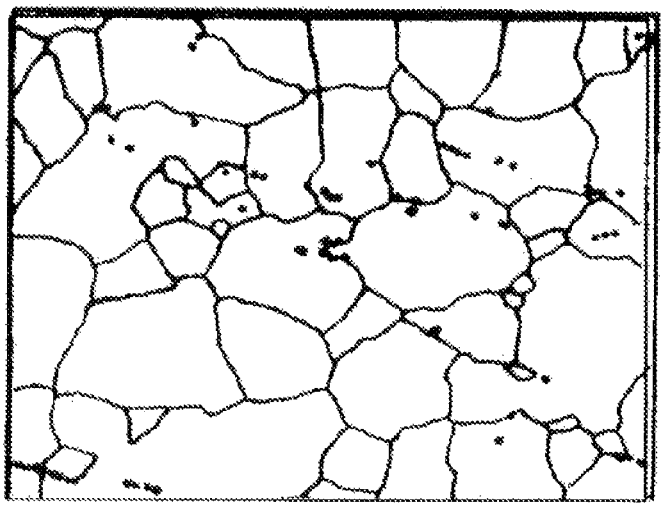
FIG. 2 is a schematic drawing of an optical micro-photographic cross-sectional view of the invention Ni-base alloy subjected to homogenization heat treatment at 1,180° C.
Figure 3:
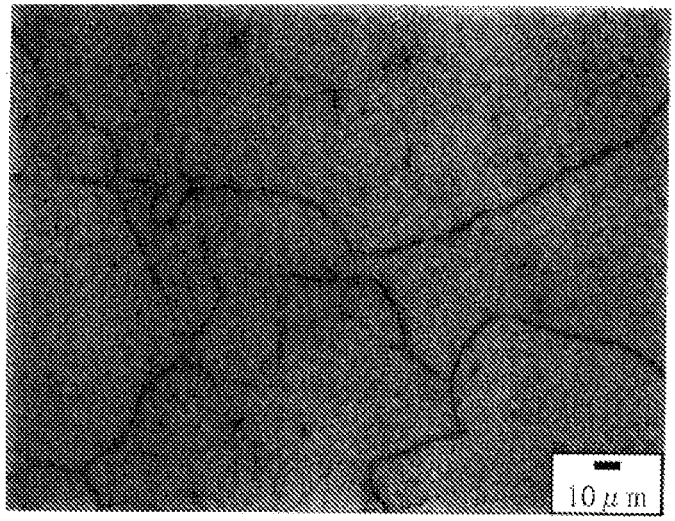
FIG. 3 is an optical micro-photographic cross-sectional view of a Ni-base alloy of the present invention subjected to homogenization heat treatment at 1,200° C.
Figure 4:
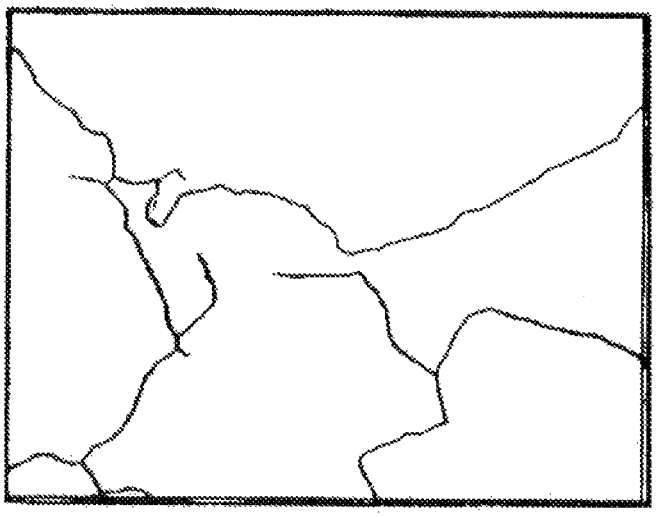
FIG. 4 is a schematic drawing of an optical micro-photographic cross-sectional view of the invention Ni-base alloy subjected to homogenization heat treatment at 1,200° C.

For example, FIG. 1 is an optical micro-photographic cross-sectional view of a Ni-base alloy subjected to homogenization heat treatment at 1,180° C. and subsequently to solid solution heat treatment and aging treatment, and FIG. 2 is a schematic view thereof. FIG. 3 is an optical micro-photographic cross-sectional view of a Ni-base alloy subjected to homogenization heat treatment at 1,200° C. followed by solid solution treatment and aging treatment, and FIG. 4 is a schematic view thereof.

In the invention Ni-base alloy subjected to homogenization heat treatment at 1,180° C., it is found that a small amount of Mo rich carbides ($M_6C$) having a maximum size of 5 μm remain. In the Ni-base alloy subjected to homogenization heat treatment at 1,200° C., Mo-base carbides are scarcely found. This will be a result that segregation in an ingot has been eliminated or reduced by homogenization heat treatment at high temperature.

Such an observation of the metal structure can be satisfactorily made merely by observing 5 to 10 fields of locations where carbides agglomerated by means of a ×400 magnification optical microscope, thereby measuring carbide sizes and distributions.

Elimination of micro segregation is attainable by the invention manufacturing process. The invention Ni-base alloy is suitable for medium or small-size forgings such as steam turbine blades and bolts, and large size products such as steam turbine rotors and boiler tubes.

In the case where the Ni-base alloy is used in the above applications, it is possible to provide a product subjected to a combination of solid solution heat treatment and aging treatment, or a product subjected only to solid solution heat treatment, for example. The effect of eliminating micro segregation by virtue of the homogenization heat treatment is not vanished by solid solution heat treatment and/or aging treatment. Even if any heat treatment is applied to the invention Ni-base alloy, it is possible to obtain stable mechanical properties thereof.

EXAMPLE

Example 1

Ten-kilogram ingots were prepared by vacuum induction melting, and Ni-base alloy materials having chemical compositions given in Table 1, the contents of chemical compositions of which were within the composition range defined in the invention, were obtained. The balance was Ni and impurities.

On the Ni-base alloy material (ingot) of alloy No. 1 given in Table 1, homogenization heat treatment was conducted at temperatures in the range of 1,140 to 1,220° C. for 20 hours. Thereafter, to confirm the presence of micro segregation, a 10 mm-square specimen was sampled from the obtained ingot, and EPMA line analysis was carried out. The EPMA line analysis was carried out by 7.5 μm steps in a length of 3 mm under the following conditions: the acceleration voltage was 15 kV, the probe current was $3.0\times10^{-7}$ A, and the probe diameter was 7.5 μm, and the segregation ratio, which is the ratio of the maximum value to the minimum value of X-ray intensity, was calculated.

The EPMA line analysis was carried out in the direction crossing the dendrite.

On the Ni-base alloy material (i.e. ingot) of alloy No. 2, homogenization heat treatment was not conducted and heating to 1,100° C. and hot forging were conducted. On the other hand, on the Ni-base alloy materials (i.e. ingots) of alloy Nos. 3 to 10, homogenization heat treatment was conducted at temperatures in the range of 1,160 to 1,220° C. for 20 hours, and thereafter hot forging was conducted at 1,100° C. In all alloy materials of alloy Nos. 2 to 10, forging cracks and the like were not initiated, and the forgeability was excellent.

On the Ni-base alloy materials of alloy Nos. 2 to 10, after hot forging, to confirm the presence of micro segregation, a 10 mm-square specimen was sampled from the obtained Ni-base alloy having been forged, and EPMA line analysis was carried out. The EPMA line analysis was carried out by 7.5 μm steps in a length of 3 mm under the following conditions: the acceleration voltage was 15 kV, the probe current was $3.0\times10^{-7}$ A, and the probe diameter was 7.5 μm, and the segregation ratio, which is the ratio of the maximum value to the minimum value of X-ray intensity, was calculated. The Mo segregation ratio is given in Table 2. The EPMA line analysis was made in the direction at right angles to the longitudinal direction of the forging.

Regarding macro segregation, a macro-structure test was conducted to visually check the presence of segregation. The alloy in which etching unevenness was found is indicated by "no", and the alloy in which etching unevenness was not found is indicated by "yes". Table 2 additionally gives the results of segregation check.

TABLE 1

(by mass %)

| Alloy No. | C | Si | Mn | Ni | Cr | Mo | W | Al | Ti | Zr | B | Fe | Mg | Al/(Al + 0.56Ti) | Mo + 0.5W |
|---|---|---|---|---|---|---|---|---|---|---|---|---|---|---|---|
| 1 | 0.030 | 0.01 | 0.01 | Balance | 19.68 | 9.78 | — | 1.16 | 1.70 | 0.06 | 0.0036 | — | 0.0001 | 0.55 | 9.78 |
| 2 | 0.031 | 0.01 | 0.01 | Balance | 19.98 | 9.65 | 0.03 | 1.14 | 1.62 | 0.01 | 0.0046 | — | 0.0005 | 0.56 | 9.67 |
| 3 | 0.028 | 0.01 | 0.01 | Balance | 19.98 | 9.93 | 0.02 | 1.18 | 1.66 | 0.01 | 0.0045 | — | 0.0009 | 0.56 | 9.94 |
| 4 | 0.033 | 0.01 | 0.01 | Balance | 19.98 | 9.96 | 0.03 | 1.19 | 1.66 | 0.01 | 0.0046 | — | 0.0010 | 0.56 | 9.98 |
| 5 | 0.034 | 0.01 | 0.01 | Balance | 20.27 | 11.85 | 0.01 | 1.22 | 1.67 | 0.01 | 0.0047 | — | 0.0010 | 0.57 | 11.85 |
| 6 | 0.032 | 0.02 | 0.01 | Balance | 20.26 | 11.89 | 0.01 | 1.23 | 1.66 | 0.02 | 0.0042 | — | 0.0012 | 0.57 | 11.90 |
| 7 | 0.037 | 0.01 | 0.01 | Balance | 21.81 | 9.92 | 0.02 | 1.20 | 1.65 | 0.02 | 0.0045 | — | 0.0010 | 0.56 | 9.93 |
| 8 | 0.035 | 0.01 | 0.02 | Balance | 21.87 | 9.96 | 0.01 | 1.21 | 1.64 | 0.03 | 0.0044 | — | 0.0011 | 0.57 | 9.97 |
| 9 | 0.037 | 0.01 | 0.01 | Balance | 19.02 | 9.30 | 0.02 | 1.59 | 1.52 | 0.04 | 0.0041 | — | 0.0022 | 0.65 | 9.30 |
| 10 | 0.032 | 0.02 | 0.01 | Balance | 19.13 | 9.33 | 0.02 | 1.60 | 1.53 | 0.03 | 0.0042 | — | 0.0021 | 0.65 | 9.34 |

*Note 1:
A mark "—" means "no addition".
*Note 2:
"Balance" includes impurities.

TABLE 2

| Alloy No. | Base material of specimen alloy | Conditions of homogenization heat treatment | Mo Segregation ratio | Is there macro segregation? | Remarks |
|---|---|---|---|---|---|
| 1 | Ingot | no heat treatment | 1.57 | yes | Comparative specimen |
| | Ingot | 1140° C. × 20 h | 1.18 | yes | Comparative specimen |
| | Ingot | 1160° C. × 20 h | 1.16 | yes | Invention specimen |
| | Ingot | 1180° C. × 20 h | 1.12 | yes | Invention specimen |
| | Ingot | 1200° C. × 20 h | 1.06 | yes | Invention specimen |
| | Ingot | 1220° C. × 20 h | 1.06 | yes | Invention specimen |
| 2 | Forged material | no heat treatment | 1.49 | yes | Comparative specimen |
| 3 | Forged material | 1180° C. × 20 h | 1.09 | yes | Invention specimen |
| 4 | Forged material | 1200° C. × 20 h | 1.06 | yes | Invention specimen |
| 5 | Forged material | 1160° C. × 20 h | 1.14 | yes | Invention specimen |
| 6 | Forged material | 1200° C. × 20 h | 1.08 | yes | Invention specimen |
| 7 | Forged material | 1160° C. × 20 h | 1.14 | yes | Invention specimen |
| 8 | Forged material | 1200° C. × 20 h | 1.06 | yes | Invention specimen |
| 9 | Forged material | 1160° C. × 20 h | 1.14 | yes | Invention specimen |
| 10 | Forged material | 1200° C. × 20 h | 1.08 | yes | Invention specimen |

As shown in Table 2, the Mo segregation ratio of the invention alloy that is subjected to homogenization heat treatment at a temperature of 1,160° C. or higher and subjected to hot forging at 1,100° C. takes a small value of 1.17 or smaller, so that it is found that micro segregation is small. A higher homogenization treatment temperature shows a tendency for the Mo segregation ratio to become small, so that it is found that the effect of reducing micro segregation is greater when the homogenization heat treatment is conducted at a higher temperature.

On the other hand, in comparative example in which the homogenization heat treatment temperature was not conducted, the Mo segregation ratio after hot forging is higher than 1.17, which suggests that much micro segregation remains.

On the Ni-base alloy Nos. 2, 3, 4, 6 and 10 in Table 2, solid solution heat treatment and aging treatment were conducted under the typical conditions applied to the actual products, and the mechanical properties were examined. The specimen was sampled along the longitudinal direction of the forging.

In the solid-solution heat treatment, the alloy was heated at 1,066° C. for four hours and thereafter was air cooled. In the aging treatment, the alloy was heated at 850° C. for four hours and thereafter was air cooled as the first-stage aging treatment, and was heated at 760° C. for 16 hours and thereafter was air cooled as the second-stage aging treatment.

To evaluate the mechanical properties of these heat-treated materials, a tensile test at room temperature and 700° C. and a creep rupture test at 700° C. were conducted. The results of tensile test at room temperature and 700° C. are given in Table 3. The results of creep rupture test conducted at a test temperature of 700° C. and at stresses of 490 N/mm$^2$ and 385 N/mm$^2$ are given in Table 4.

TABLE 3

| Alloy No. | Homogenization heat treatment | Test temperature (° C.) | 0.2% proof stress (N/mm$^2$) | Tensile strength (N/mm$^2$) | Elongation (%) | Reduction of area (%) | Remarks |
|---|---|---|---|---|---|---|---|
| 2 | no | Room temperature | 643.9 | 1083.2 | 38.4 | 48.8 | Comparative specimen |
| 3 | 1180° C. | Room temperature | 715.0 | 1161.6 | 37.6 | 53.1 | Invention specimen |
| 4 | 1200° C. | Room temperature | 690.0 | 1143.0 | 38.1 | 49.7 | Invention specimen |

TABLE 3-continued

| Alloy No. | Homogenization heat treatment | Test temperature (° C.) | 0.2% proof stress ($N/mm^2$) | Tensile strength ($N/mm^2$) | Elongation (%) | Reduction of area (%) | Remarks |
|---|---|---|---|---|---|---|---|
| 6 | 1200° C. | Room temperature | 818.0 | 1209.0 | 33.2 | 47.4 | Invention specimen |
| 10 | 1200° C. | Room temperature | 790.0 | 1204.0 | 36.5 | 52.9 | Invention specimen |
| 2 | no | 700° C. | 570.0 | 878.0 | 26.3 | 23.6 | Comparative specimen |
| 3 | 1180° C. | 700° C. | 615.8 | 917.4 | 37.4 | 32.5 | Invention specimen |
| 4 | 1200° C. | 700° C. | 595.0 | 912.0 | 34.7 | 39.8 | Invention specimen |
| 6 | 1200° C. | 700° C. | 707.0 | 957.0 | 40.0 | 39.7 | Invention specimen |
| 10 | 1200° C. | 700° C. | 702.0 | 953.0 | 40.1 | 49.6 | Invention specimen |

TABLE 4

| | | Stress: 490 $N/mm^2$ | | Stress: 385 $N/mm^2$ | | |
|---|---|---|---|---|---|---|
| Alloy No. | Homogenization heat treatment | Rupture time (Hr) | Reduction of area (%) | Rupture time (Hr) | Reduction of area (%) | Remarks |
| 2 | no | 84.6 | 27.4 | 836.5 | 35.5 | Comparative specimen |
| 3 | 1180° C. | 139.6 | 31.6 | 1077.0 | 33.4 | Invention specimen |
| 4 | 1200° C. | 149.5 | 35.0 | 1366.9 | 34.9 | Invention specimen |
| 6 | 1200° C. | 114.7 | 54.1 | — | — | Invention specimen |
| 10 | 1200° C. | 136.2 | 54.2 | — | — | Invention specimen |

Table 3 reveals that all of the Ni-base alloy Nos. 3, 4, 6 and 10 of Invention Specimens subjected to homogenization heat treatment have a higher proof stress and tensile strength at room temperature and 700° C. and a larger elongation and reduction of area at 700° C. than the Ni-base alloy No. 2 of Comparative Specimen not subjected to homogenization heat treatment, and therefore, by conducting homogenization heat treatment, the tensile properties can stably be made excellent.

Also, Table 4 reveals that all of the Ni-base alloy Nos. 3, 4, 6 and 10 of Invention Specimens subjected to homogenization heat treatment have a longer creep rupture life at 700° C. than the Ni-base alloy No. 2 of Comparative Specimen not subjected to homogenization heat treatment, and have a rupture reduction of area equivalent to or larger than that of the Ni-base alloy No. 2 of Comparative Specimen, and therefore, by conducting homogenization heat treatment, the creep rupture properties of the alloys can stably be made excellent. Also, the alloy Nos. 6 and 10 were not subjected to the creep rupture test conducted at a test temperature of 700° C. and at a stress of 385 $N/mm^2$. However, from the relationship between the creep rupture lives at 490 $N/mm^2$ stress and 385 $N/mm^2$ of alloy Nos. 2, 3 and 4, there can be seen a correlation such that the alloy having a rupture long life at 490 $N/mm^2$ stress also has a long rupture life at 385 $N/mm^2$ as well. Therefore, it can be presumed that the alloy Nos. 6 and 10 of Invention Specimens as well have excellent creep rupture properties at a test temperature of 700° C. and at a stress of 385 $N/mm^2$ like the alloy Nos. 3 and 4 of Invention Specimen.

Table 5 shows the results of measurements of average thermal expansion coefficients at temperatures from 30° C. to 1,000° C. of the Ni-base alloy Nos. 3 and 4 of Invention Specimen and the Ni-base alloy No. 2 of Comparative Specimen. Herein, the thermal expansion coefficient was measured by a differential thermal expansion measuring instrument by using a round-bar test piece having a diameter of 5 mm and a length of 19.5 mm sampled in parallel with the longitudinal direction of the forging.

From Table 5, it is conceivable that the thermal expansion coefficient at the test piece level of this test is scarcely influenced by micro segregation because no difference was recognized in the average thermal expansion coefficients from 30° C. to each temperature of the Ni-base alloy Nos. 3 and 4 of Invention Specimen and the Ni-base alloy No. 2 of Comparative Specimen.

On the Ni-base alloy Nos. 3 and 4 of Invention Specimens subjected to aging treatment, cross section metallographic structure observation was made to examine the distribution and sizes of carbides. The examination was made by observing 10 fields of a location in which carbides coagulate by using an optical microscope at ×400 magnification. FIGS. 1 to 4 are microphotographs of typical metallographic structures and schematic views thereof.

In the Ni-base alloy No. 3 of Invention Specimen subjected to homogenization heat treatment at 1,180° C. shown in FIGS. 1 and 2, Mo rich carbides ($M_6C$) having a maximum size of 5 μm remain in small amounts, and even in the location in which carbides coagulate, about five Mo rich carbides each having a size of 3 μm or larger were observed at intervals of 2 to 10 μm. In the Ni-base alloy subjected to homogenization heat treatment at 1,200° C. shown in FIGS. 3 and 4, Mo rich carbides themselves were scarcely found. The Mo rich carbide is a white portion on the photograph, and on the schematic view, the shape thereof is transcribed.

TABLE 5

| | Average thermal expansion coefficient ($\times 10^{-6}$/° C.) | | | | | | | | | | |
|---|---|---|---|---|---|---|---|---|---|---|---|
| No. | 30-100° C. | 30-200° C. | 30-300° C. | 30-400° C. | 30-500° C. | 30-600° C. | 30-700° C. | 30-800° C. | 30-900° C. | 30-1000° C. | Remarks |
| 2 | 11.29 | 12.12 | 12.68 | 13.07 | 13.41 | 13.67 | 14.22 | 14.56 | 15.33 | 16.17 | Comparative specimen |
| 3 | 10.97 | 12.01 | 12.65 | 13.06 | 13.44 | 13.71 | 14.32 | 14.75 | 15.56 | 16.45 | Invention specimen |
| 4 | 11.58 | 12.27 | 12.76 | 13.06 | 13.35 | 13.58 | 14.13 | 14.51 | 15.27 | 16.08 | Invention specimen |

Example 2

Next, an example to which remelting was applied is shown. In this test, ESR having the great effects of removing sulfides and removing large inclusions was applied.

An electrode for ESR was produced by vacuum induction melting. Table 6 shows the chemical compositions of the Ni-base alloy material of alloy No. 11. Herein, the impurity level of P, S, and the like was as follows: P content was 0.002%, and S content was 0.0002%. For the Ni-base alloy material of alloy No. 11, the electrode for ESR was subjected to homogenization heat treatment at 1180° C. for 20 hours after vacuum induction melting, and subsequently remelting by ESR was conducted to obtain a large ingot of a 3-ton scale. Next, the large ingot was subjected to homogenization heat treatment at 1,180° C. for 20 hours, subjected to blooming at 1150° C., and further subjected to hot forging at 1,000° C. At the time of blooming and hot forging, forging cracks and the like were not initiated, and the forgeability was excellent.

TABLE 6

(by mass %)

| Alloy No. | C | Si | Mn | Ni | Cr | Mo | W | Al | Ti | Zr | B | Fe | Mg | Al/(Al + 0.56Ti) | Mo + 0.5W |
|---|---|---|---|---|---|---|---|---|---|---|---|---|---|---|---|
| 11 | 0.031 | 0.02 | 0.01 | Balance | 19.97 | 10.02 | 0.02 | 1.16 | 1.55 | 0.01 | 0.0055 | 0.54 | 0.0019 | 0.57 | 10.03 |

*Note:
"Balance" includes impurities.

To confirm the presence of micro segregation, a 10 mm-square specimen was sampled from the hot-forged forging of the Ni-base alloy of alloy No. 11 given in Table 6, and EPMA line analysis was carried out. The EPMA line analysis was carried out by 7.5 μm steps in a length of 3 mm under the following conditions: the acceleration voltage was 15 kV, the probe current was $3.0\times10^{-7}$ A, and the probe diameter was 7.5 μm, and the segregation ratio, which is the ratio of the maximum value to the minimum value of X-ray intensity, was calculated. Table 7 gives Mo segregation ratio. The EPMA line analysis was carried out in the direction at right angles to the longitudinal direction of the forging.

Regarding macro segregation, a macro-structure test was conducted to visually check the presence of segregation. The alloy in which etching unevenness was found is indicated by "no", and the alloy in which etching unevenness was not found is indicated by "yes".

TABLE 7

| Alloy No. | Conditions of homogenization heat treatment | Mo Segregation ratio | Is there macro segregation? | Remarks |
|---|---|---|---|---|
| 11 | 1180° C. × 20 h | 1.10 | yes | Invention specimen |

Table 7 reveals that the Mo segregation ratio of the Ni-base alloy No. 11 of Invention Specimen subjected to homogenization heat treatment at 1180° C. and subjected to hot forging takes a value as small as 1.10, so that micro segregation is small.

Next, on the Ni-base alloy of alloy No. 11, solid solution heat treatment and aging treatment were conducted under the typical conditions applied to the actual products, and the mechanical properties were examined. The specimen was sampled along the longitudinal direction of the forging.

In the solid-solution heat treatment, the alloy was heated at 1066° C. for four hours and thereafter was air cooled. In the aging treatment, the alloy was heated at 850° C. for four hours and thereafter was air cooled as the first-stage aging treatment, and was heated at 760° C. for 16 hours and thereafter was air cooled as the second-stage aging treatment.

To evaluate the mechanical properties of the heat-treated material, a tensile test at room temperature and 700° C. and a creep rupture test at 700° C. were conducted. The results of tensile test at room temperature and 700° C. are given in Table 8. The results of creep rupture test conducted at a test temperature of 700° C. and at stresses of 490 N/mm$^2$ and 385 N/mm$^2$ are given in Table 9.

TABLE 8

| Alloy No. | Homogenization heat treatment | Test temperature (° C.) | 0.2% proof stress ($N/mm^2$) | Tensile strength ($N/mm^2$) | Elongation (%) | Reduction of area (%) | Remarks |
|---|---|---|---|---|---|---|---|
| 11 | 1180° C. | Room temperature | 676.0 | 1139.0 | 37.2 | 49.8 | Invention Specimen |
| | 1180° C. | 700° C. | 598.0 | 902.0 | 65.0 | 61.1 | Invention specimen |

TABLE 9

| | | Stress: 490 $N/mm^2$ | | Stress: 385 $N/mm^2$ | | |
|---|---|---|---|---|---|---|
| Alloy No. | Homogenization heat treatment | Rupture time (Hr) | Reduction of area (%) | Rupture time (Hr) | Reduction of area (%) | Remarks |
| 11 | 1180° C. | 126 | 65.5 | 859.2 | 66.2 | Invention specimen |

Table 8 reveals that the Ni-base alloy No. 11 of Invention Specimen subjected to homogenization heat treatment at 1180° C. and subjected to the remelting process has a high proof stress and tensile strength at room temperature and 700° C. and a large elongation and reduction of area at 700° C., and therefore, shows excellent tensile properties.

Also, Table 9 reveals that the Ni-base alloy No. 11 of Invention Specimen subjected to homogenization heat treatment at 1180° C. and subjected to the remelting process has a long creep rupture life at 700° C. and a large rupture reduction of area, and therefore, shows stable and excellent creep rupture properties.

Example 3

Next, an example to which VAR was applied is shown.

An electrode for VAR was produced by vacuum induction melting. Table 10 shows the chemical compositions of the Ni-base alloy material of alloy No. 12. For the Ni-base alloy material of alloy No. 12, the electrode for VAR was subjected to homogenization heat treatment at 1200° C. for 20 hours after vacuum melting, and subsequently remelting by VAR was conducted to obtain a large ingot of a 1-ton scale. Next, the large ingot was subjected to homogenization heat treatment at 1180° C. for 20 hours, subjected to blooming at 1,150° C., and further subjected to hot forging at 1,000° C. At the time of blooming and hot forging, forging cracks and the like were not initiated, and the forgeability was excellent.

TABLE 10

| Alloy No. | C | Si | Mn | Ni | Cr | Mo | W | Al | Ti | Zr | B | Fe | Mg | (by mass %) Al/(Al + 0.56Ti) | Mo + 0.5W |
|---|---|---|---|---|---|---|---|---|---|---|---|---|---|---|---|
| 12 | 0.030 | 0.03 | 0.01 | Balance | 19.95 | 9.93 | 0.03 | 1.18 | 1.57 | 0.05 | 0.0051 | 0.32 | 0.0011 | 0.57 | 9.95 |

*Note:
"Balance" includes impurities.

To confirm the presence of micro segregation, a 10 mm-square specimen was sampled from the hot-forged forging of the Ni-base alloy of alloy No. 12 given in Table 10, and EPMA line analysis was carried out. The EPMA line analysis was made by 7.5 μm steps in a length of 3 mm under the following conditions: the acceleration voltage was 15 kV, the probe current was $3.0\times10^{-7}$ A, and the probe diameter was 7.5 μm, and the segregation ratio, which is the ratio of the maximum value to the minimum value of X-ray intensity, was calculated. The EPMA line analysis was carried out in the direction at right angles to the longitudinal direction of the forging. Table 11 gives Mo segregation ratio.

Regarding macro segregation, a macro-structure test was conducted to visually check the presence of segregation. The alloy in which etching unevenness was found is indicated by "no", and the alloy in which etching unevenness was not found is indicated by "yes".

TABLE 11

| Alloy No. | Conditions of homogenization heat treatment | Mo Segregation ratio | Is there macro segregation? | Remarks |
|---|---|---|---|---|
| 12 | 1200° C. × 20 h | 1.10 | yes | Invention specimen |

Table 11 reveals that the Mo segregation ratio of the Ni-base alloy No. 12 of Invention Specimen subjected to homogenization heat treatment at 1,200° C. and subjected to hot forging takes a value as small as 1.10, so that micro segregation is small.

Next, on the Ni-base alloy No. 12, solid solution heat treatment and aging treatment were conducted under the typical conditions applied to the actual products, and the mechanical properties were examined. The specimen was sampled along the longitudinal direction of the forging.

In the solid-solution heat treatment, the alloy was heated at 1,066° C. for four hours and thereafter was air cooled. In the aging treatment, the alloy was heated at 850° C. for four hours and thereafter was air cooled as the first-stage aging treatment, and was heated at 760° C. for 16 hours and thereafter was air cooled as the second-stage aging treatment.

To evaluate the mechanical properties of the heat-treated material, a creep rupture test at 700° C. was conducted. The results of creep rupture test conducted at a test temperature of 700° C. and at stresses of 490 $N/mm^2$ and 385 $N/mm^2$ are given in Table 12.

TABLE 12

| Alloy No. | Homogenization heat treatment | Stress: 490 N/mm$^2$ Rupture time (Hr) | Stress: 490 N/mm$^2$ Reduction of area (%) | Stress: 385 N/mm$^2$ Rupture time (Hr) | Stress: 385 N/mm$^2$ Reduction of area (%) | Remarks |
|---|---|---|---|---|---|---|
| 12 | 1200° C. | 143 | 55.2 | 890 | 66.2 | Invention specimen |

Table 12 reveals that the Ni-base alloy No. 12 of Invention Specimen subjected to homogenization heat treatment at 1,180° C. and subjected to the remelting process has a long creep rupture life at 700° C. and a large rupture reduction of area, and therefore, shows stable and excellent creep rupture properties.

Example 4

Next, an example in which the influence of micro segregation in the direction at right angles to the longitudinal direction of the forging was examined is shown.

Ten-kilogram ingots were prepared by vacuum induction melting. Table 13 gives the chemical compositions thereof. The ingot of alloy No. 13 was heated to 1,100° C. and was hot forged without being subjected to homogenization heat treatment. The ingots of alloy Nos. 14 and 15 were subjected to homogenization heat treatment at 1,140° C. and 1,200° C., respectively, for 20 hours, and were hot forged at 1,100° C. In the ingots of alloy Nos. 13 to 15, forging cracks and the like were not generated, and the forgeability was excellent.

TABLE 13

(by mass %)

| Alloy No. | C | Si | Mn | Ni | Cr | Mo | W | Al | Ti | Zr | B | Fe | Mg | Al/(Al + 0.56Ti) | Mo + 0.5W |
|---|---|---|---|---|---|---|---|---|---|---|---|---|---|---|---|
| 13 | 0.034 | 0.01 | 0.01 | Balance | 19.98 | 9.93 | — | 1.25 | 1.60 | 0.09 | 0.0046 | — | 0.0055 | 0.58 | 9.93 |
| 14 | 0.031 | 0.04 | 0.01 | Balance | 20.22 | 9.92 | — | 1.17 | 1.61 | 0.10 | 0.0034 | — | 0.0016 | 0.56 | 9.92 |
| 15 | 0.033 | 0.01 | 0.01 | Balance | 20.27 | 9.98 | — | 1.24 | 1.62 | 0.10 | 0.0046 | — | 0.0036 | 0.58 | 9.98 |

*Note 1:
A mark "—" means "no addition".
*Note 2:
"Balance" includes impurities.

After hot forging, to confirm the presence of micro segregation, a 10 mm-square specimen was sampled from the obtained forging, and EPMA line analysis was carried out. The EPMA line analysis was made by 7.5 μm steps in a length of 3 mm under the following conditions: the acceleration voltage was 15 kV, the probe current was $3.0\times10^{-7}$ A, and the probe diameter was 7.5 μm, and the segregation ratio, which is the ratio of the maximum value to the minimum value of X-ray intensity, was calculated. The EPMA line analysis was carried out in the direction at right angles to the longitudinal direction of the forging. Table 14 gives Mo segregation ratio.

Regarding macro segregation, a macro-structure test was conducted to visually check the presence of segregation. The alloy in which etching unevenness was found is indicated by "no", and the alloy in which etching unevenness was not found is indicated by "yes".

TABLE 14

| Alloy No. | Conditions of homogenization heat treatment | Mo Segregation ratio | Is there macro segregation? | Remarks |
|---|---|---|---|---|
| 13 | no heat treatment | 1.45 | yes | Comparative specimen |
| 14 | 1140° C. × 20 h | 1.19 | yes | Comparative specimen |
| 15 | 1200° C. × 20 h | 1.06 | yes | Invention specimen |

Table 14 reveals that, in alloy No. 13 of Comparative Specimen not subjected to homogenization heat treatment and alloy No. 14 subjected to homogenization heat treatment at 1140° C., the Mo segregation ratio after hot forging is higher than 1.17, and much micro segregation remains, and on the other hand, in alloy No. 15 of Invention Specimen subjected to homogenization heat treatment at 1,200° C., the Mo segregation ratio after hot forging is lower than 1.17, and micro segregation is small.

On the alloy Nos. 13 to 15, solid solution heat treatment and aging treatment were conducted under the typical conditions applied to the actual products, and the mechanical properties were examined. The creep rupture test piece and the Charpy impact test piece were sampled along the direction at right angles to the longitudinal direction of the forging.

In the solid-solution heat treatment, the alloy was heated at 1066° C. for four hours and thereafter was air cooled. In the aging treatment, the alloy was heated at 850° C. for four hours and thereafter was air cooled as the first-stage aging treatment, and was heated at 760° C. for 16 hours and thereafter was air cooled as the second-stage aging treatment.

To evaluate the mechanical properties of these heat-treated materials, a creep rupture test at 700° C. was conducted. The creep rupture test was conducted on the alloy Nos. 13 to 15 by using two test pieces each. The results of creep rupture test conducted at a test temperature of 700° C. and at stresses of 490 N/mm$^2$ and 385 N/mm$^2$ are given in Table 15. To make sure of this, a 2 mm V-notch Charpy impact test was conducted at 23° C. for the main purpose of easily detecting the influence of micro segregation. The Charpy impact test was conducted on the alloy Nos. 13 to 15 by using three test pieces each. The results of Charpy Impact test at a test temperature of 23° C. are given in Table 16.

TABLE 15

| Alloy No. | Homogenization heat treatment | Stress: 490 N/mm$^2$ Rupture time (Hr) | Stress: 490 N/mm$^2$ Reduction of area (%) | Stress: 385 N/mm$^2$ Rupture time (Hr) | Stress: 385 N/mm$^2$ Reduction of area (%) | Remarks |
|---|---|---|---|---|---|---|
| 13 | no | 174.9 | 59.0 | 708.1 | 53.3 | Comparative specimen |
| | | 158.4 | 58.0 | 1009.8 | 50.9 | |
| 14 | 1140° C. | 130.4 | 49.3 | 881.6 | 51.0 | Comparative specimen |
| | | 129.4 | 51.1 | 1078.3 | 49.1 | |
| 15 | 1200° C. | 194.6 | 38.9 | 1322.0 | 39.5 | Invention specimen |
| | | 185.1 | 39.9 | 1251.2 | 28.2 | |

TABLE 16

| Alloy No. | Homogenization heat treatment | Impact value (J/cm$^2$) | Remarks |
|---|---|---|---|
| 13 | no | 73.3 | Comparative |
| | | 76.7 | specimen |
| | | 76.0 | |
| 14 | 1140° C. | 72.7 | Comparative |
| | | 78.7 | specimen |
| | | 80.1 | |
| 15 | 1200° C. | 93.7 | Invention |
| | | 90.3 | specimen |
| | | 91.2 | |

Table 15 reveals that the alloy No. 15 of Invention Specimen subjected to homogenization heat treatment at 1200° C. has a longer creep rupture life and shows smaller variations than the alloy Nos. 13 and 14 of Comparative Specimens, and therefore, can provide excellent creep rupture properties stably.

Also, Table 16 reveals that the alloy No. 15 of Invention Specimen subjected to homogenization heat treatment at 1200° C. shows a higher impact value and has higher toughness stably than the alloy Nos. 13 and 14 of Comparative Specimens. Therefore, it can be confirmed that by implementing homogenization heat treatment defined in the present invention, micro segregation is eliminated.

From the above results, it is found that in the Ni-base alloy to which the manufacturing process of the present invention is applied, both of macro segregation and micro segregation can be restrained.

From this fact, it is apparent that the Ni-base alloy of the present invention has excellent mechanical properties such as strength and ductility at temperatures in the range of room temperature to high temperature.

INDUSTRIAL APPLICABILITY

If the invention manufacturing process is applied, both of macro segregation and micro segregation can be restrained. Therefore, there can be provided a Ni-base alloy suitable for various parts used for, for example, a 700° C.-class ultra super critical pressure thermal power plant.

The invention claimed is:

1. A Ni-base alloy material consisting of, by mass, not more than 0.15% carbon, not more than 1% Si, not more than 1% Mn, from 10 to 24% Cr, a combination of an essential element of Mo and an optional element W in terms of 5%≤Mo+(W/2)≤13%, from 0.5 to 1.8% Al, from 1 to 2.5% Ti, not more than 0.0005 to 0.0030% Mg, at least one element selected from the group of B and Zr in amounts of not more than 0.02% B and not more than 0.2% Zr, optionally Fe and the balance being Ni and unavoidable impurities, wherein the value of Al/(Al+0.56Ti) is 0.45 to 0.70, wherein the Ni-base alloy material has a Mo segregation ratio of 1 to 1.17, and which has not a region in which a series of ten or more Mo rich carbides, each having a size of not less than 3 μm, are continuously present at intervals of not more than 10 μm.

2. The Ni-base alloy material according to claim 1, wherein the Mo segregation ratio is 1 to 1.10.

3. The Ni-base alloy material according to claim 1, wherein Fe is present in an amount of not more than 5%.

4. The Ni-base alloy material according to claim 1, which is a forged product.

5. A Ni-base alloy material according to claim 1, which consists of, by mass, from 0.015% to 0.040% carbon, less than 0.1% Si, less than 0.1% Mn, from 19 to 22% Cr, a combination of an essential element of Mo and an optional element W in terms of 9%≤Mo+(W/2)≤12%, from 1.0 to 1.7% Al, from 1.4 to 1.8% Ti, from 0.0005 to 0.0030% Mg, from 0.0005 to 0.010% B, from 0.005 to 0.07% Zr, not more than 2% Fe, and the balance being Ni and unavoidable impurities, wherein the value of Al/(Al+0.56Ti) is 0.50 to 0.70.

6. The Ni-base alloy material according to claim 5, wherein Al is present in an amount of, by mass, from 1.0 to 1.3%.

7. The Ni-base alloy material according to claim 5, wherein Al is present in an amount of, by mass, from more than 1.3 to 1.7%.

* * * * *